US008573123B1

(12) United States Patent
Fuchs et al.

(10) Patent No.: US 8,573,123 B1
(45) Date of Patent: Nov. 5, 2013

(54) FLEXIBLE DETONATOR INTEGRATED WITH DIRECTLY WRITTEN ENERGETICS

(75) Inventors: Brian E. Fuchs, Hackettstown, NJ (US); James L. Zunino, III, Boonton Township, NJ (US); Daniel P. Schmidt, Madison, NJ (US); Daniel Stec, III, Long Valley, NJ (US); Anne Marie Petrock, Flanders, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 372 days.

(21) Appl. No.: 13/109,344

(22) Filed: May 17, 2011

Related U.S. Application Data

(60) Provisional application No. 61/345,697, filed on May 18, 2010.

(51) Int. Cl.
*F42B 3/12* (2006.01)
*F42B 3/195* (2006.01)

(52) U.S. Cl.
USPC ..... 102/202.7

(58) Field of Classification Search
USPC ..... 102/202.7, 202.5, 202.8
See application file for complete search history.

(56) References Cited

U.S. PATENT DOCUMENTS

| | | | | |
|---|---|---|---|---|
| 6,677,034 | B1 * | 1/2004 | Hooley et al. | 428/323 |
| 2004/0123764 | A1 * | 7/2004 | Hatzl et al. | 102/202.5 |
| 2006/0243151 | A1 * | 11/2006 | Vine et al. | 102/202.5 |
| 2010/0068154 | A1 * | 3/2010 | Sharma et al. | 424/40 |

* cited by examiner

*Primary Examiner* — Michael Carone
*Assistant Examiner* — Reginald Tillman, Jr.
(74) *Attorney, Agent, or Firm* — Henry S. Goldfine

(57) ABSTRACT

A method of forming a conductive ink bridge wire EED on either a flat or curved substrate, wherein a finely detailed bridge wire EED is printed on the substrate using a nano-particle conductive material applied with a commercially available piezoelectric drop-on-demand ink jet printer—which bridge wire is subsequently coated with a first primary explosive layer, an optional second transition explosive layer, and a third secondary explosive layer—such that upon creating a current through the bridge wire EED, the bridge wire is heated and the explosive layers detonate in turn, and in turn initiate the detonation of the device to which the detonator is attached.

11 Claims, 2 Drawing Sheets

FLEXIBLE DETONATOR INTEGRATED WITH DIRECTLY WRITTEN ENERGETICS

CROSS REFERENCE TO RELATED APPLICATIONS

This application claims the benefit under 35 USC §119(e) of U.S. provisional patent application U.S. 61/345,697, filed on May 18, 2010, which provisional application is co-pending herewith, and is hereby incorporated herein by reference.

FEDERAL RESEARCH STATEMENT

The inventions described herein may be manufactured, used, and licensed by, or for the U.S. Government, for U.S. Government purposes.

BACKGROUND OF INVENTION

1. Field of the Invention

The present invention relates to electro-thermal initiated explosive devices, and in particular, to a method of forming a bridge wire resistance element, integral with a composite primary and secondary set of charges, that can be directly applied to a flexible substrate.

2. Related Art

Electro-explosive devices (EED's) are well known in the art and include such devices as primers, detonators, and squibs. These devices generally include a pair of lead wires which are connected through a bridge wire or other bridge element that is supported on a generally flat surface and contacted with a primary explosive, i.e. a sensitive, deflagration charge. The bridge wire is generally a resistance element that is usually formed of a very thin wire of circular cross section or a thin foil element, though other forms are possible, such as disclosed in U.S. Pat. No. 3,974,424, where the resistive element is of a generally flat S-shaped configuration having two arcuate resistor portions which are joined by a connecting portion. The bridge wire or resistance element generally has an electrical resistance which is appreciably greater than the electrical resistance of the lead wires. Therefore, passage of an electrical current through the leads and the resistive bridge element causes the later to be heated or to spark, and thereby firing the primary deflagration charge.

A well known safety hazard of such electro-explosive devices is that they can be accidently fired by static electricity. A safety requirement therefore is the "one ampere-one watt no fire" requirement. This requirement states that a device must be capable of dissipating one watt of power while one ampere of current is passed through the bridge element without firing. This indirectly fixes the desired combined resistance of the lead wires and the bridge element at one ohm. The combined lead wire and bridge element resistance is generally held between 0.9 and 1.1 ohms. If the total resistance is too low, the one watt requirement will not be met; if it is too high, excessive heating due to higher power dissipation will result.

The primary explosive is sensitive in that it will explode with relatively little stimulus—in a deflagration effect, i.e. creating a flame front by its explosive decomposition—a relative low energetic explosion in which flame front moves relatively slowly though the energetic material in contrast to a detonation type explosive. The purpose of this relatively low energetic explosion is to subsequently ignite a more energetic transition or secondary explosive material—that is more powerful than the primary explosive; but, which creates a detonation, i.e. an explosive effect marked by the propagation of a shock wave that transverses the explosive material. The shock wave from a secondary explosive can typically reach thousands of meters per second and create the desired significant effect. The stimulus (such as the bridge wire), the primary explosive and the secondary explosive form an "explosive train." Often, there is an intermediate sensitive, intermediate explosive force, transition explosive between the primary and secondary explosive materials—to ensure that the explosive train functions smoothly.

Current modern weapons systems designs require bridge wire EED's which are rugged, to withstand the acceleration and/or spin forces applied thereto when incorporated in high military speed shells or rockets. Which bridge wire EED's must further meet diverse requirements—such as multi-point initiation, non-traditional configurations (including substrates which are not flat), and different voltage availability. Finally, and importantly, the bridge wire EED's must be miniaturizable, to conform to modern systems miniaturization for size and mass reduction—utilizing micro-electromechanical fuze systems (MEMS) based technology and processes, which are based upon lithographic techniques, or offshoot techniques such as plating, molding, plastic injection, and/or ceramic casting—examples of such applications of MEMS technology are disclosed in a series of patents to Robinson and Robinson et al., including U.S. Pat. No. 6,167,809, issued Jan. 2, 2001; U.S. Pat. No. 6,568,329, issued May 27, 2003; U.S. Pat. No. 6,964,231, issued Nov. 15, 2005; and, U.S. Pat. No. 7,316,186, issued Jan. 8, 2008. Typical processes for loading energetic materials (e.g. pressing, melt-pouring, or curing) are incompatible with the desire to reduce component size and mass. Further, such applications often involving handling of dry energetic material, which presents safety concerns.

There is a need in the art for a method of forming rugged bridge wire EED's that can meet the various safety requirements for an electro-explosive device and be easily miniaturized and tailored to conform to multi-point initiation, non-traditional configurations (including curved, i.e. non-flat, substrates) and different voltage availability—bridge wire EED's that have smaller footprints and that can be integrated into a MEMS dimensioned devices—and that are easy to manufacture.

SUMMARY OF INVENTION

In order to achieve the objectives detailed above, the subject inventive method first provides a method to form a detonator, including a finely detailed bridge wire EED, i.e. a "printed" pair of conductive lead wires and a resistive bridge wire therebetween—the "printed" using a conductive ink containing nano-particle silver, aluminum, or other conductive metal, which conductive ink is applied using a commercially available piezoelectric type, drop-on-demand ink jet printer and a PC or Mac, using a graphics program, such MS Visio, Photoshop, Paint, etc. After the conductive ink is applied to the desired substrate, which can be a flexible sheet, the substrate with the ink is annealed (about 200 to about 300 degrees Celsius, for about 5 to about 10 minutes) to remove the solvent from the ink and leave a fully conductive, i.e. sintered, bridge wire EED on the substrate. The elements of the explosive detonation train are applied in layers directly atop the printed resistive bridge wire; i.e. first a primary explosive (e.g. such as a lead styphnate based material); next, optionally, a transition explosive material (e.g. such as a lead azide based material); and finally, a secondary explosive material (e.g. such as a CL-20, RDX, HMX, PETN, TNAZ, and the like, based material). Wherein, when a low voltage is applied across the bridge wire EED, the bridge wire is heated and the primary explosive thereon detonates; thereby, detonating any transition explosive, the secondary explosive, and any adjacent secondary booster pellet or explosive billet—to detonate the device which the subject detonator is designed to detonate.

The explosive materials are preferably as disclosed in U.S. Pat. No. 7,052,562, to Stec III, et al. (which U.S. Patent is hereby incorporated herein by reference), i.e. in the form of a slurry which can contain from about 30 to about 70 weight percent of the explosive, about 0.01 to about 10 weight percent binder, with the balance, i.e. quantity sufficient, or q.s., being the organic, aqueous, or mixed solvent—a slurry which will easily and precisely flow from a syringe for application thereof. It is critical that this slurry be applied to the underlying bridge wire EED—printed pair of conductive lead wires and resistive bridge wire—without the applicator touching the bridge wire EED (i.e. only the wet explosive material can touch the bridge wire EED)—to ensure that there is no damage done to the bridge wire EED.

In a preferred embodiment of the present inventive detonator, the primary energetic material, transitional energetic material, and secondary energetic material are each applied atop the bridge wire via a syringe or using a direct-write positive displacement system (such as a Model EFD-100XL precision fluid dispensing system, available from Nordson EFD, Robbinsville, N.J., or the like). Each layer can be put down in one pass—the quantity being that adequate to fully cover the wire bridge. Wherein the completed bridge wire EED with layered primary, transition, and secondary energetic is immediately attached to a secondary booster pellet or directly to an explosive billet, to provide the initiation thereof and detonate the particular explosive device.

Surprisingly, the adhesion of the primary adhesive to the "printed" bridge wire EED within the present inventive detonator, was found to be extraordinarily strong and secure—to the conductive ink bridge wire EED. Such that the layered primary energetic material, transitional energetic material, and secondary energetic material were so bonded to the "printed" bridge wire EED, such that if the subject inventive detonator were used in a high velocity shell, it would easily withstand the very high-G forces of acceleration and spin thereof.

Further features and advantages of the present invention will be set forth in, or apparent from, the detailed description of preferred embodiments thereof which follows.

DETAILED DESCRIPTION

The present invention details a method of forming a bridge wire EED detonator on a flexible substrate, the process steps being: (1) printing a nano-particle conductive ink applied, using a piezo based drop on demand ink jet printer, to provide a finely detailed bridge wire EED set of conductive lead wires and a resistive bridge wire therebetween on a substrate, which substrate may be non-flexible, i.e. flat, or, flexible; (2) drying, i.e. annealing, the printed bridge wire EED to remove the solvent from the ink and leave a sintered, fully conductive, electrical circuit; (3) applying in layers, first a primary explosive layer (e.g. such as a lead styphnate based material); next, optionally, a transition explosive material layer (e.g. such as a lead azide based material); and finally, a secondary explosive material layer (e.g. such as a CL-20, RDX, HMX, PETN, TNAZ, and the like, based material) atop the bridge wire; and (4) allow each layer to dry, prior to applying the next wet layer. As stated above, the layered explosives were found to bond surprisingly securely to the printed conductive ink—which is a critical feature for any high speed munitions, whether a shell or rocket; especially, given that such munitions are routinely subjected to extremes in temperature and pressure.

Figure 1:
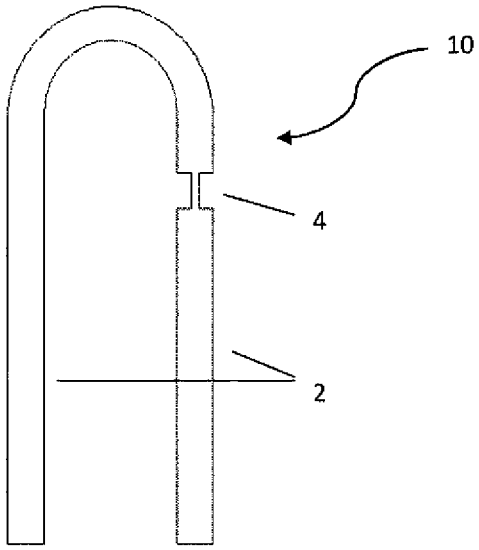
FIG. 1. is top-down cross-sectional schematic rendition of the electrical leads and resistive bridge of a bridge wire EED, as that of the subject inventive method.

FIG. 1 shows a cross-sectional schematic rendition of the electrical leads and resistive bridge of a bridge wire EED, 10, as that applied in the subject inventive method. As detailed herein, the electrical leads, 2, and the bridge wire, 4, are "printed" of a conductive ink, using a piezo based type, drop-on-demand ink jet printer.

Figure 2:
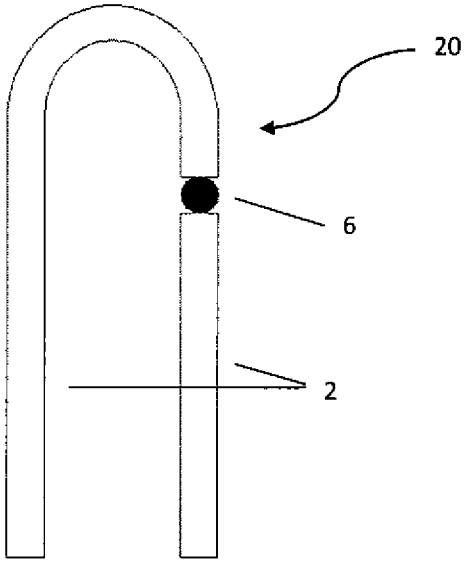
FIG. 2. is a top-down cross-sectional schematic rendition of a bridge wire EED with energetic material deposited on the bridge, as that of the subject inventive method.
Figure 3:
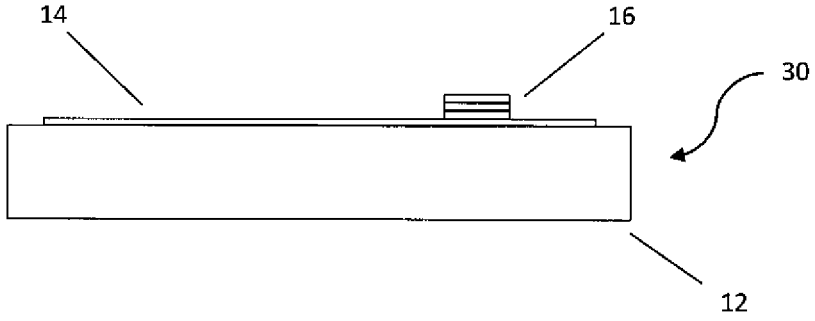
FIG. 3 is a profile cross-sectional schematic view of a preferred embodiment of the present invention.

FIG. 2 shows a complete cross-sectional schematic rendition of the bridge wire EED, 20, with the energetic material deposited on the bridge, as applied thereto in the subject inventive method. FIG. 3 shows further detail thereof, specifically showing the layering of energetics onto the bridge wire EED device, 30; wherein, a printed hotwire device, 14, on a substrate 12 (which substrate may be flexible, such as a Kapton membrane, or flat and rigid, such as a metal plate). The layered energetics, 16, atop the bridge wire is shown to include, a first very sensitive primary explosive, a second transition (i.e. a less sensitive primary explosive) and a third secondary energetic layer. In an alternative embodiment, the second transition layer may be omitted—such that the very sensitive primary first layer will initiate a second secondary energetic layer placed directly thereon.

In a preferred embodiment, after the bridge wire EED is printed on the substrate and annealed, to form a layer of conductive material on the order of about 100 to about 200 nanometers thick. In one embodiment the bridge wire can have a width of 51 μm and a length of 1.1 mm; and the leads can have a width 3.8 mm and a length of 7.6 cm. Further, the bridge wire EED can be coated with an encapsulating material, to protect it from the environment—a barrier to moisture—which coating will not affect the flexibility of the printed bridge wire EED. Preferably, a polyimide coating, such as Pyralin PI-2574, available from HD MicroSystems, Parlin, N.J. 08859, is used—though there are numerous alternatives thereto. This coating can be applied in a controlled manner to only cover the subject bridge wire EED—by several well known alternative techniques, including ink jetting, brushing, spin coating, spraying, etc.

In one aspect, the present invention is comprised of a conductive ink bridge wire EED, applied on a non-flexible, or flexible, substrate using a piezo based drop on demand ink jet printer; wherein the conductive ink is preferably a nano-particle silver based ink, containing at least about 20% by weight silver). Though any conductive material in nano form can be used—such as aluminum, copper, or carbon—as long as, the material (1) can disperse uniformly in an acceptable solvent; (2) has a particle size of less than 200 nm (preferably less than 100 nm); (2) fit through the inject nozzle (typically, 30 μm diameter); (3) sinters, i.e. fuses, into a continuous electrical conductor at a temperature below about 350 degrees Celsius (preferably sinter at a temperature of from about 200 to about 300 degrees Celsius); and (4) be compatible with the primary energetic layered atop thereof, i.e. so as to firmly bond thereto. Preferred nano-particle silver based inks, that meet these conditions, can be obtained from SunChemical, Parsippany, N.J. 07054, as a SunJet Crystal® Inkjet, SunTronic Jettable Silver U5603 or U5714; or, from Cabot, Boston, Mass. 02210, as silver ink CCI-300.

Further, the preferred nano-silver based ink has a viscosity of from about 10 to about 30 centipoise and a surface tension of from about 28 to about 33 dynes/cm (to form the desired droplets using available ink jet technology and avoid leaking from the ink jet nozzles). Also, any ink with a very low boiling point, below room temperature, will tend to clog the ink jet nozzles—such as acetone. And, acetone, or other similarly aggressive solvent, will also tend to attack the nozzle material of construction. Preferred solvents include a mixture of solvents, such as including, ethanol, ethylene glycol, glycerin, ethanediol, 2-isopropaozyethanol, and the like. Additional useful solvents include, but are not limited to, butanol, toluene, dimethylformamide (DMF), methyl ethyl ketone (MEK), and even water.

Particular substrates for printing the subject bridge wire EED detonator using ink jet printers of the subject method; includes, without limitation, any rigid or flexible substrate, which may be metallic, ceramic, dielectric, polymeric, or organic in construction. A particularly preferred, flexible substrate, for use with the present inventive method is poly (4,4'-oxydiphenylene-pyromellitimide) film, available from DuPont Electronic Technologies, Circleville, Ohio 43113 as Kapton®—which is a known film material for providing flexible substrates for printed electrical circuits.

In a particularly preferred embodiment of the present invention, the substrate with the ink jetted pattern is annealed for from about 5 to about 10 minutes at from about 200 to 300 degrees Celsius, more preferably from about 225 to about 275 degrees Celsius—to drive off the solvent and sinter the nanoparticles together into a continuous electrical circuit.

Ink jet printers useful with the nano-particle conductive inks of the present invention preferably utilize a piezoelectric drop-on-demand ink delivery system—which printers can deliver programmed, on-demand, droplets of from about 1 picoliter (pL) to about 10 pL microscopic ink droplets. Therefore, the desired bridge wire EED detonator is formed of ink droplets, each of which produces a generally disc-shaped upon the substrate after losing the solvent by the drying, annealing process detailed above—each disc having a diameter of about 20 to about 50 micrometers. The spacing between the droplets is controllable by the adjustments to the printer between 5 and 250 microns—a spacing of between 5 to 50 micrometers is preferred to maximize the overlap of the droplets upon the substrate, for a more solid circuit pattern. Further, pattern thicknesses of up to about 1 micron, to about 1.5 microns or more were achieved by repeating the printing process, i.e. each pass of the substrate under the ink jet printer formed a layer, with each layer being from about 0.1 to about 0.3 microns—until the desired thickness was achieved. To precisely control the dimensions of the printed circuit (especially the bridge wire), subsequent layers were printed using a modified design—which modification included only the inside portion of the leads. At least two of these subsequent passes were required to achieve reproducible resistance ratios. Further, it is noteworthy that the pattern thickness that may be obtained in each pass, and in total, is limited only by the capabilities of the printer—where such printers may have more than one head and thereby reduce the number of required passes (for the build-up to the desired thickness). A particular ink-jet printer which meets the requirements is a Fujifilm Dimatrix® Ink Jet, DMP-2800 series; though piezo-based and other style materials printers from HP, Xerox, Spectra, Optomec, and many others, can be used.

In a preferred embodiment of the present inventive detonator, the primary energetic material, transitional energetic material, and secondary energetic material are each applied atop the bridge wire via a syringe or more preferably using a direct-write positive displacement system, such as a Model EFD-100XL precision fluid dispensing system, available from Nordson EFD, Robbinsville, N.J., or the like. The more preferred Nordson EFD system is an air-driven delivery system which pressurizes a syringe of the explosive and delivers the material through a needle or other specialized tip. The actual delivery is due only to air pressure, not electrically- or gear-driven, so it is a safe, "soft" method for depositing the energetic. It is used to deliver all the explosive inks, primary, transition, and secondary. Each layer of which can be put down in one pass, with the applicator never touching the underlying bridge wire EED circuit so as not to cause any damage thereto. Further, as the energetic layers are only layered as wet material, there is less potential for an accidental discharge (a significant safety feature of the present invention). Finally, as shown in FIG. 2, the quantity of layered energetic is that which is adequate to fully cover the wire bridge. And, wherein the completed bridge wire EED with layered primary, transition, and secondary energetic is immediately attached to a secondary booster pellet or directly to an explosive billet, to provide the initiation thereof and detonate the particular explosive device.

Although the invention has been described above in relation to preferred embodiments thereof, it will be understood by those skilled in the art that variations and modifications can be effected in these preferred embodiments without departing from the scope and spirit of the invention as claimed below.

What is claimed is:

1. A method of forming a bridge wire EED detonator, the method comprising the steps of:

printing, using a piezo based, drop-on-demand, ink jet printer, a bridge wire EED on a substrate using a conductive ink;

annealing the printed bridge wire EED to remove the solvent from the ink and leave a sintered, fully conductive, electric bridge wire circuit;

applying a series of layers of explosive material, first a primary explosive layer, a transition layer, and then a secondary explosive layer, atop said printed bridge wire;

allowing each layer to dry before applying the next layer of explosive material; and, wherein, said layers of explosive material adhere securely to said printed bridge wire.

2. The method of forming a bridge wire EED detonator of claim 1, wherein said bridge wire EED contains a set of lead wires and a resistive bride, which resistive bridge wire heats when an electrical current is channeled therethrough; such that the primary explosive is heated and explodes; thereby exploding the transition and secondary explosives, in turn, and detonating a secondary booster pellet or detonating an explosive billet, either of which is located immediately adjacent thereto.

3. The method of forming a bridge wire EED detonator of claim 1, wherein said printed bridge wire EED is printed of a nano-particle Ag, wherein the particles are on average less than 200 nano-meters in diameter.

4. The method of forming a bridge wire EED detonator of claim 1, wherein said primary explosive is a very sensitive lead styphnate based material; said transition explosive is a less sensitive lead azide based material; and said secondary explosive material is selected from the group consisting of CL-20, RDX, HMX, PETN and TNAZ.

5. The method of forming a bridge wire EED detonator of claim 1, wherein said annealing is done at a temperature of from about 200 to about 300 degrees Celsius, for a period of from about 5 to about 10 minutes.

6. The method of forming a bridge wire EED detonator of claim 1, wherein said annealing is done at a temperature of from about 225 to about 375 degrees Celsius, for a period of from about 5 to about 10 minutes.

7. The method of forming a bridge wire EED detonator of claim 1, wherein said layers of energetic material are applied using a syringe.

8. The method of forming a bridge wire EED detonator of claim 3, wherein said nano-particle Ag conductive ink has a viscosity of from about 10 to about 20 centi-poise and a surface tension of from about 28 to 33 dynes/cm.

9. The method of forming a bridge wire EED detonator of claim 1, wherein said substrate is a flexible material.

10. A method of forming a bridge wire EED detonator of claim 9, wherein said flexible material is poly (4,4'-oxydiphenylene-pyromellitimide) film.

11. A method of forming a bridge wire EED detonator, the method comprising the steps of:

printing, using a piezo based, drop-on-demand, ink jet printer, a bridge wire EED on a substrate using a conductive ink;

annealing the printed bridge wire EED to remove the solvent from the ink and leave a sintered, fully conductive, electric bridge wire circuit;

applying two layers of explosive material, first a primary explosive layer, and then a secondary explosive layer, atop said printed bridge wire;

allowing each layer to dry before applying the next layer of explosive material; and, wherein, said layers of explosive material adhere securely to said printed bridge wire.

* * * * *